US007310031B2

(12) United States Patent
Pance et al.

(10) Patent No.: US 7,310,031 B2
(45) Date of Patent: Dec. 18, 2007

(54) DIELECTRIC RESONATORS AND CIRCUITS MADE THEREFROM

(75) Inventors: Kristi Dhimiter Pance, South Boston, MA (US); Eswarappa Channabasappa, Acton, MA (US)

(73) Assignee: M/A-COM, Inc., Lowell, MA (US)

( * ) Notice: Subject to any disclaimer, the term of this patent is extended or adjusted under 35 U.S.C. 154(b) by 199 days.

(21) Appl. No.: 10/268,415

(22) Filed: Oct. 10, 2002

(65) Prior Publication Data

US 2004/0051602 A1 Mar. 18, 2004

Related U.S. Application Data

(60) Provisional application No. 60/411,337, filed on Sep. 17, 2002.

(51) Int. Cl.
*H01P 7/10* (2006.01)

(52) U.S. Cl. ..... 333/219; 333/219.1; 333/202; 333/222

(58) Field of Classification Search ..... 333/219, 333/219.1, 202, 222
See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | 333/73 W |
| 4,138,652 | A | 2/1979 | Nishikawa et al. | 333/82 R |
| 4,267,537 | A | 5/1981 | Karmel | 333/231 |
| 4,423,397 | A | 12/1983 | Nishikawa et al. | 333/219 |
| 4,459,570 | A | 7/1984 | Delaballe et al. | 333/202 |
| 4,477,785 | A | 10/1984 | Atia | 333/202 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,810,984 | A | 3/1989 | Arnold et al. | 333/202 |
| 4,821,006 | A | 4/1989 | Ishikawa et al. | 333/202 |

(Continued)

FOREIGN PATENT DOCUMENTS

EP 0 492 304 A1 12/1991

(Continued)

OTHER PUBLICATIONS

Dielectric Constants of Various Materials, http://www.csgnetwork.com/dieconstantstabe.html.*

(Continued)

*Primary Examiner*—Benny Lee
*Assistant Examiner*—Kimberly E Glenn

(57) ABSTRACT

A dielectric resonator having variable cross-section, preferably varying monotonically, and, most preferably, the resonator being in the shape of a truncated cone. Such shapes displace the $H_{11}$ mode from the TE mode in the longitudinal direction of the cone. Truncating the cone to eliminate the portion of the cone where the $H_{11}$ mode exists, virtually eliminates the $H_{11}$ mode. A circuit comprising a plurality of these resonators may be arranged in an enclosure with each resonator longitudinally inverted relative to adjacent resonator(s) to provide a compact design with enhanced coupling and adjustability. A spiral coupling loop provides high magnetic flux in a small physical volume for coupling energy into or out of the circuit. Alternately, the resonator can coupled to a microstrip by placing the resonator upside-down near the microstrip, whereby the TE mode is immediately above the microstrip, providing enhanced coupling there between.

19 Claims, 8 Drawing Sheets

U.S. PATENT DOCUMENTS

| | | | | | |
|---|---|---|---|---|---|
| 4,835,498 | A | | 5/1989 | Rouger et al. | 333/205 |
| 4,881,051 | A | | 11/1989 | Tang et al. | 333/208 |
| 5,059,929 | A | | 10/1991 | Tanaka | 333/219.1 |
| 5,109,207 | A | * | 4/1992 | Aizawa et al. | 333/222 |
| 5,140,285 | A | | 8/1992 | Cohen | 331/96 |
| 5,218,330 | A | | 6/1993 | Omiya et al. | 333/223 |
| 5,347,246 | A | | 9/1994 | Bellows et al. | 333/219 |
| 5,525,945 | A | | 6/1996 | Chiappetta et al. | 333/202 |
| 5,614,875 | A | * | 3/1997 | Jang et al. | 333/202 |
| 5,691,677 | A | | 11/1997 | De Maron et al. | 333/219.1 |
| 5,748,058 | A | | 5/1998 | Scott | 333/202 |
| 5,841,330 | A | | 11/1998 | Wenzel et al. | 333/202 |
| 5,859,574 | A | | 1/1999 | Schmitt | 333/202 |
| 5,990,767 | A | | 11/1999 | Ivanov et al. | 333/219.1 |
| 6,087,910 | A | | 7/2000 | Matsumoto et al. | 333/202 |
| 6,100,703 | A | | 8/2000 | Davidov et al. | 324/631 |
| 6,208,227 | B1 | | 3/2001 | Remillard et al. | 333/219 |
| 6,254,708 | B1 | | 7/2001 | Cappabianca | 156/89.12 |
| 6,337,664 | B1 | | 1/2002 | Mayes et al. | 343/749 |
| 6,707,353 | B1 | * | 3/2004 | Yamakawa et al. | 333/202 |
| 6,717,490 | B1 | * | 4/2004 | Mayer | 333/202 |
| 6,784,768 | B1 | | 8/2004 | Pance et al. | 333/219 |
| 2004/0051602 | A1 | | 3/2004 | Pance et al. | 333/202 |
| 2004/0051603 | A1 | | 3/2004 | Pance et al. | 333/202 |

FOREIGN PATENT DOCUMENTS

| | | | | |
|---|---|---|---|---|
| EP | 0 601 370 | A1 | | 6/1994 |
| EP | 1 162 684 | A3 | | 12/2001 |
| EP | 1 181 740 | | | 3/2003 |
| GB | 1376938 | | | 12/1974 |
| GB | 1520 473 | | | 8/1978 |
| JP | 57-014202 | A | | 1/1982 |
| JP | 36-3280503 | A | | 11/1988 |
| JP | 01-144701 | | | 6/1989 |
| JP | 02-137502 | | | 5/1990 |
| JP | 05-102714 | | | 4/1993 |
| JP | 05-267940 | | | 10/1993 |
| JP | 6061714 | | * | 3/1994 |
| JP | 06-061714 | | * | 4/1994 |
| JP | 07-154114 | A | | 6/1995 |
| JP | 07154116 | A | * | 6/1995 |
| JP | 03-249803 | | | 9/2003 |
| WO | WO 00/70706 | | | 11/2000 |
| WO | WO 01/43221 | | | 6/2001 |
| WO | WO 2004/027917 | | | 4/2004 |

OTHER PUBLICATIONS

Kishk et al., "Conical Dielectric Resonator Antennas for Wide-Band Applications," IEEE Transactions on Antennas and Propogation, 50(4):469-474 (2002).

Hui et al. "Dielectric Ring-Gap Resonator for Application in MMIC's" IEEE Transactions on Microwave Theory and Techniques, vol. 39, No. 12, Nov. 1991.

"Dielectric Resonators", D. Kajfez and P. Guillon ISBN 0-89006-201-3, Publisher Artech House, Dedham, NA 1986, pp. 298-317.

"Quantum Proximity Resonances", E. J. Heller, Physical Review Letters, vol. 77, No. 20, Nov. 11, 1966 The American Physical Society, pp. 4122-4125.

"Tunneling Proximity Resonances: Interplay Between Symmetry and Dissipation" K. Pance et al., Physics Department, Northwestern University Aug. 2, 1999, T-143, pp. 16-18, F426.

"Observation of Proximity Resonances in a Parallel-Plate Waveguide" J.S. Hersch, et al. Physical Review Letters, vol. 81, No. 15, Oct. 12, 1998 The American Physical Society, pp. 3059-3062.

M. A. Gerdine, "A Frequency-Stabilized Microwave Band-Rejection Filter Using High Dielectric Constant Resonators", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{01\delta}$ Dielectric Resonator Modes" Electronics Letters, May 25, 1989, vol. 25 No. 11, pp. 693-694.

T. Nishikawa et al., "Dielectric High-Power Bandpass Filter Using Quarter-Cut $TE_{01\delta}$ Image Resonator for Cellular Base Stations", IEEE Transactions on Microwave Theory and Techniques, vol. MTT-35, No. 12, Dec. 1987, pp. 1150-1155.

* cited by examiner

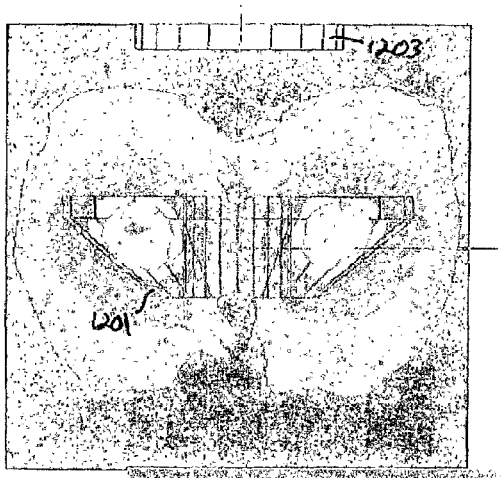
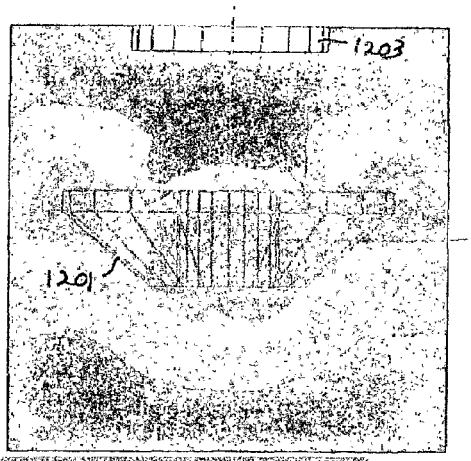
| | Frequency (GHz) | Q |
|---|---|---|
| Mode 1 | ( 1.91806e+000, 2.02861e-004) | 4.72751e+003 |
| Mode 2 | ( 2.78747e+000, 2.59077e-004) | 5.37962e+003 |
Figure 12A
Figure 12B
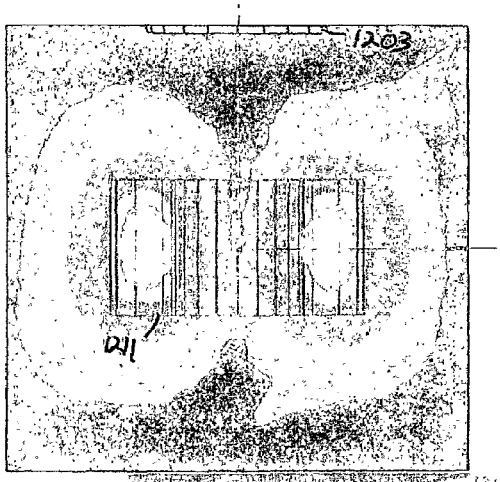
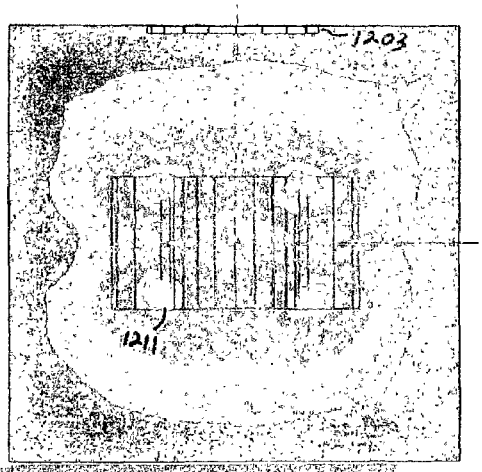
| | Frequency (GHz) | Q |
|---|---|---|
| Mode 1 | ( 1.96358e+000, 2.03446e-004) | 4.82581e+003 |
| Mode 2 | ( 2.69208e+000, 2.68819e-004) | 5.00723e+003 |
Figure 12C
Figure 12D

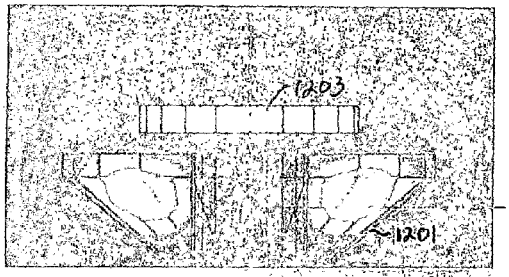
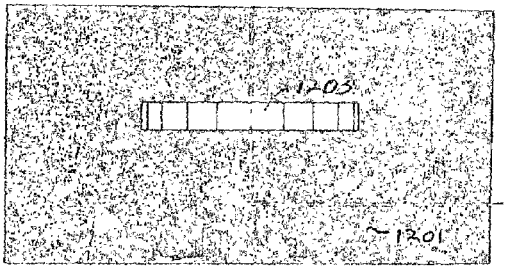
Frequency (GHz) Q
Mode 1 ( 2.27922e+000, 3.78687e-004) 3.00937e+003
Mode 2 ( 3.02671e+000, 3.40951e-004) 4.43864e+003
Figure 12E Figure 12F
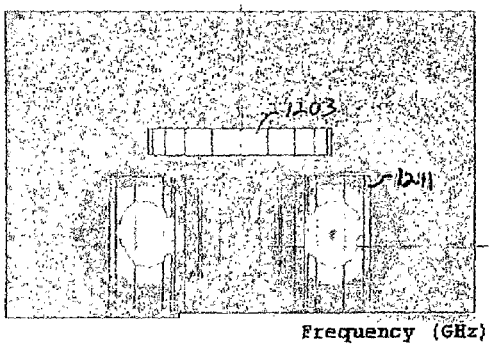
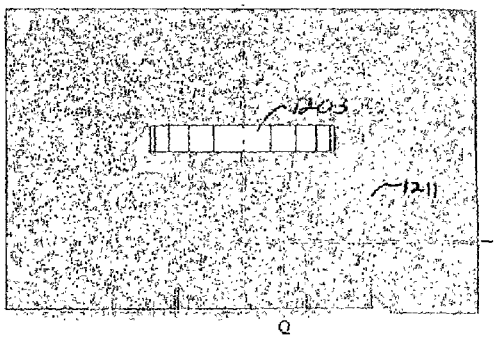
Frequency (GHz) Q
Mode 1 ( 2.25586e+000, 3.34288e-004) 3.37413e+003
Mode 2 ( 2.46863e+000, 2.34769e-004) 5.25758e+003
Figure 12G Figure 12H

DIELECTRIC RESONATORS AND CIRCUITS MADE THEREFROM

RELATED APPLICATION

This application claims the benefit of U.S. Provisional Application entitled "Dielectric Resonators and Circuits Made Therefrom," filed Sep. 17, 2002, Application No. 60/411,337.

FIELD OF THE INVENTION

The invention pertains to dielectric resonators, such as those used in microwave circuits for concentrating electric fields, and to the circuits made from them, such as microwave filters, oscillators, triplexers, antennas etc.

BACKGROUND OF THE INVENTION

Dielectric resonators are used in many circuits, particularly microwave circuits, for concentrating electric fields. They can be used to form filters, oscillators, triplexers and other circuits. The higher the dielectric constant of the dielectric material out of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a mu (magnetic constant) of 1, i.e., they are transparent to magnetic fields.

FIG. 1 is a perspective view of a typical dielectric resonator of the prior art. As can be seen, the resonator 10 is formed as a cylinder 12 of dielectric material with a circular, longitudinal through hole 14. Individual resonators are commonly called "pucks" in the relevant trades. While dielectric resonators have many uses, their primary use is in connection with microwaves and particularly, in microwave communication systems and networks.

As is well known in the art, dielectric resonators and resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is the transverse electric field mode, $TE_{01\delta}$ (or TE, hereafter). Typically, it is the fundamental TE mode that is the desired mode of the circuit or system into which the resonator is incorporated. The second mode is commonly termed the hybrid mode, $H_{11\delta}$ (or $H_{11}$ hereafter). The $H_{11}$ mode is excited from the dielectric resonator, but a considerable amount of electric field lays outside the resonator and, therefore, is strongly affected by the cavity. The $H_{11}$ mode is the result of an interaction of the dielectric resonator and the cavity within which it is positioned and has two polarizations. The $H_{11}$ mode field is orthogonal to the TE mode field. There are additional higher modes. Typically, all of the modes other than the mode of interest, e.g., the TE mode, are undesired and constitute interference. The $H_{11}$ mode, however, typically is the only interference mode of significant concern. The remaining modes usually have substantial frequency separation from the TE mode and thus do not cause significant interference with operation of the system. The $H_{11}$ mode, however, tends to be rather close in frequency to the TE mode. In addition, as the frequency of the TE mode is tuned, the center frequency of the TE mode and the $H_{11}$ mode move in opposite directions to each other. Thus, as the TE mode is tuned to increase its center frequency, the center frequency of the $H_{11}$ mode inherently moves downward and, thus, closer to the TE mode center frequency. By contrast, the third mode, commonly called the $H_{12}$ mode, not only is sufficiently spaced in frequency from the TE mode so as not to cause significant problems, but, in addition, it moves in the same direction as the TE mode responsive to tuning.

FIG. 2 is a perspective view of a microwave dielectric resonator filter 20 of the prior art employing a plurality of dielectric resonators 10. The resonators 10 are arranged in the cavity 22 of a conductive enclosure 24. The conductive enclosure 24 typically is rectangular, as shown in FIG. 2. Microwave energy is introduced into the cavity via a coupler 28 coupled to a cable, such as a coaxial cable. Conductive separating walls 32 separate the resonators from each other and block (partially or wholly) coupling between physically adjacent resonators 10. Particularly, irises 30 in walls 32 control the coupling between adjacent resonators 10. Walls without irises generally prevent any coupling between adjacent resonators. Walls with irises allow some coupling between adjacent resonators. Conductive adjusting screws may be placed in the irises to further affect the fields of the adjacent resonators and provide adjustability of the coupling between the resonators, but are not shown in the example of FIG. 2. By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. Wall 32*a*, which does not have an iris, prevents the field of resonator 10*a* from coupling with physically adjacent resonator 10*d* on the other side of the wall 32*a*.

One or more metal plates 42 are attached to the top cover plate (top cover plate not shown) to affect the field of the resonator to set the center frequency of the filter. Particularly, plate 42 may be mounted on a screw 43 passing through top cover plate (not shown) of enclosure 24 that may be rotated to vary the spacing between the plate 42 and the resonator 10 to adjust the center frequency of the resonator. An output coupler 40 is positioned adjacent the last resonator 10*d* to couple the microwave energy out of the filter 20 and into a coaxial connector (not shown). Signals also may be coupled into and out of a dielectric resonator circuit by other methods, such as microstrips positioned on the bottom surface 44 of the enclosure 24 adjacent the resonators. The sizes of the resonator pucks 10, their relative spacing, the number of pucks, the size of the cavity 22, and the size of the irises 30 all need to be precisely controlled to set the desired center wavelength of the filter and the bandwidth of the filter. More specifically, the bandwidth of the filter is controlled primarily by the amount of coupling of the electric and magnetic fields between the electrically adjacent resonators. Generally, the closer the resonators are to each other, the more coupling between them and the wider the bandwidth of the filter. On the other hand, the center frequency of the filter is controlled in large part by the size of the resonators themselves and the size and spacing of the conductive plates 42 from the corresponding resonators 10. Generally the larger the resonator, the lower its center frequency may be.

Prior art dielectric resonator filters have limited frequency bandwidth performance. The maximum frequencies at which they can perform effectively is typically limited to about 55 to 60 GHz. The effective bandwidth range of prior art dielectric resonator filters is typically on the order of 3 to 20 MHz. In particular, the bandwidth is restricted because the couplings between resonators are limited.

Prior art resonators and the circuits made from them have many drawbacks. For instance, as a result of the positions of the fields of the resonators, prior art resonators have limited ability to couple with other resonators (or with other microwave devices such as loop couplers and microstrips). That is why filters made from prior art resonators have limited bandwidth range. Further, prior art dielectric resonator circuits such as the filter shown in FIG. 2 suffer from poor quality factor, Q, due to the presence of separating walls and coupling screws. Q essentially is an efficiency rating of the system and, more particularly, is the ratio of stored energy to lost energy in the system. The fields generated by the resonators pass through all of the conductive components of the system, such as the enclosure 20, plates 42 internal walls 32 and 34, and adjusting screws 43 and inherently generate currents in those conductive elements. Those currents essentially comprise energy that is lost to the system.

Furthermore, the volume and configuration of the conductive enclosure 24, substantially affects the operation of the system. The enclosure minimizes radiative loss. However, it also has a substantial effect on the center frequency of the TE mode. Accordingly, not only must the enclosure be constructed of a conductive material, but it must be very precisely machined to achieve the desired center frequency performance, thus adding complexity and expense to the fabrication of the system. Even with very precise machining, the design can easily be marginal and fail specification.

Even further and perhaps most importantly, prior art resonators have poor mode separation between the desired TE mode and the undesired $H_{11}$ mode.

FIGS. 3A and 3B illustrate magnitude of the electric fields for the TE and $H_{11}$ modes, respectively, in a typical prior art cylindrical resonator 10. As shown, the Electric Field 31 of the TE mode is circular, oriented transverse of the cylindrical puck 12, and is concentrated around the circumference of the resonator 10, with some of the field inside the resonator and some of the field outside the resonator. A portion of the field should be outside the resonator for purposes of coupling between the resonator and other microwave devices (e.g., other resonators or input/output couplers). If all of the field is concentrated inside the dielectric resonator, it would be very difficult to control the coupling between resonators.

The electric field of the $H_{11}$ mode is orthogonal to the TE mode. The electric field 33 forms a circle around the puck 10 parallel to the page and is concentrated near the surface. It is very difficult to physically separate the $H_{11}$ mode from the TE mode. Accordingly, methods for suppressing the $H_{11}$ mode have been developed in the prior art. For instance, metal strips 41 such as illustrated in FIG. 4 have been placed on the surface of the resonators to suppress the $H_{11}$ mode by causing its tangential electric field to be zero at the metal strips 41, effectively causing the suppression of the mode because its maximum field strength is located near the metal strips. In practice, while this technique for suppressing the $H_{11}$ mode is relatively effective in terms of suppressing the $H_{11}$ mode, it also typically suppresses the TE mode significantly. In theory, the effect on the TE mode should be insignificant, but experiments show that this is not the case in the real world and that this method for $H_{11}$ suppression actually significantly affects Q for the TE mode. Experiments show that this technique typically might cause losses of about half of the power of the TE mode, thus substantially reducing the Q of the resonator and the overall system in which it is employed.

Accordingly, it is an object of the present invention to provide improved dielectric resonators.

It is another object of the present invention to provide improved dielectric resonator filters and other circuits employing dielectric resonators.

It is a further object of the present invention to provide a method and apparatus by which improved coupling is achieved between dielectric resonators and other devices, such as coupling loops, microstrips and other dielectric resonators.

It is another object of the present invention to provide dielectric resonators and dielectric resonator filters in which the $H_{11}$ mode is substantially suppressed or eliminated.

It is yet another object of the present invention to provide dielectric resonators and dielectric resonator circuits with improved mode separation between the TE mode and the $H_{11}$ mode.

It is yet a further object of the present invention to provide dielectric resonators and dielectric resonator circuits that are easily tunable.

It is one more object of the present invention to provide dielectric resonators and dielectric resonator circuits with more effective coupling than in the state of the art.

It is a further object of the present invention to provide dielectric resonators and dielectric resonator filters with improved Q factors.

SUMMARY OF THE INVENTION

The invention is an improved dielectric resonator and dielectric resonator circuit (i.e., a circuit that employ dielectric resonators). In one form, the invention comprises a dielectric resonator formed in the shape of a truncated cone and having a longitudinal through hole. The cone shape physically displaces the $H_{11}$ mode from the TE mode in the longitudinal direction of the cone. Particularly, the TE mode tends to concentrate in the base of the cone (the wider portion) while the $H_{11}$ mode tends to concentrate at the top of the cone (the narrower portion). By truncating the cone so as to eliminate the portion of the cone where the $H_{11}$ mode field exists, yet keep the portion of the cone where the TE mode exists, the $H_{11}$ mode can be virtually eliminated while having little effect on the magnitude of the TE mode. The angle of the side wall of the cone (i.e., its taper), can be controlled to adjust the physical separation of the TE and $H_{11}$ modes. The radius of the longitudinal hole can be adjusted either in steps or entirely to optimize insertion loss, volume, spurious response and other properties. The improved frequency separation between the TE mode and $H_{11}$ mode combined with the physical separation thereof enable tuning of the center frequency of the TE mode with a substantial reduction or even entire elimination of any effect of the tuning on the $H_{11}$ mode. This design also provides better quality factor for the TE mode, generally up to 10% better because more of the TE field is outside of the cone due to the taper in the longitudinal direction. It also enhances coupling to other microwave devices such as microstrips, input and output loops, and other resonators, enabling the construction of wider bandwidth filters.

The outer portion of the base of the conical resonator may be trimmed (e.g., such that the bottommost portion of the cone has a rectangular cross section rather than a triangular cross section). This feature further enhances coupling of the resonator to other microwave devices by allowing more of the TE mode field to be outside of the resonator. It also reduces the size of the resonators and can help reduce the size of any circuit within which such resonators are incorporated.

Resonators in accordance with the invention may be used to build low-loss, compact filters, oscillators, and other circuits, particularly microwave circuits.

In an alternate embodiment, the resonator may be a stepped cone or stepped cylinder. For instance, the lower portion of the resonator can be a cylinder of a first radius while the top of the resonator is a cylinder of a smaller radius. This also will tend to physically separate the TE mode from the $H_{11}$ mode in the longitudinal direction.

The invention also provides a low loss dielectric resonator filter employing conical dielectric resonators. The conical resonators are arranged relatively to each other within an enclosure in a very efficient and compact design that enhances coupling and the adjustability between adjacent resonators. Further, in accordance with the invention, the enclosure of the filter plays no role in guiding the electromagnetic fields, although it still plays a role in connection with grounding and radiation losses. Even further, the filter does not have to have irises between adjacent resonators or adjusting screws between adjacent resonators to vary the coupling. The coupling can be varied instead, by varying resonator spacing.

In accordance with a preferred embodiment of the invention, a plurality of conical dielectric resonators are arranged in the enclosure such that the longitudinal orientation of each resonator is flipped relative to its adjacent resonator or resonators (e.g., the side walls of adjacent conical resonators are parallel to each other) such that the resonators can fit within a much smaller space than comparable cylindrical resonators.

The use of conical resonators and their particular arrangement enhances coupling and coupling adjustability and thus expands the bandwidth range achievable by such a filter. The resonators may be mounted to the enclosure via non-conducting adjustable screws that allow the resonators to be moved longitudinally relative to each other to adjust coupling strength between adjacent resonators and thus bandwidth.

In one preferred embodiment, the distal ends of the screws mate with threaded holes in a side wall of the enclosure while the proximal ends of the screws mates with the longitudinal through holes in the resonators (which also may be threaded to mate with the screw). The screws can be rotated relative to the resonator and/or the housing to move the resonators closer or further apart from each other in the longitudinal direction to adjust the amount of coupling between the resonators and, thus, the bandwidth of the filter.

Further in accordance with the invention, a dielectric resonator filter or other circuit is provided in which the conical resonators are arranged in a radial pattern relative to each other within a cylindrical enclosure. This provides a very compact filter with all of the advantages of the previously described filter. This design is extremely compact and provides a high quality factor per unit volume. Also, high electromagnetic fields outside the dielectric resonators allow strong coupling between adjacent resonators.

In accordance with another aspect of the invention, signals are coupled into and out of dielectric resonators and dielectric resonator circuits such as filters, oscillators, etc. via a spiral loop. More particularly, a signal which may be provided to the loop in any reasonable manner, such as via a coaxial cable, is provided to a loop comprising a spiral coupling loop wire rather than a simple circular coupling loop. This design provides greater magnetic flux in the same physical area, thus providing a stronger magnetic field for coupling to the first resonator without increasing the volume of the field. Keeping the volume of the field small avoids the problem of undesired direct coupling of the input loop to the output loop, while providing extremely strong coupling into and out of the system resonators. This way of coupling can be very practical, but introduces losses because currents are generated in the spiral wire. However, this design is particularly suitable in connection with circuits employing conical resonators constructed in accordance with the principles of the present invention since the substantial increase in the Q of conical resonator circuits constructed in accordance with the present invention may make the extra losses at the couplings between the loops and the resonators acceptable.

Furthermore, conical resonators in accordance with the present invention can be positioned relative to microstrips on printed circuit boards and other substrates so as to provide enhanced electromagnetic coupling between the resonator and the microstrip. Particularly, because the TE mode tends to be concentrated in the base portion of the resonator (the wider end), the resonator can be mounted to the substrate upside down (with the base away from the substrate) in the vicinity of the microstrip. In this manner, the TE mode field concentration can be positioned above and more closely to the microstrip than is possible with cylindrical resonators. In fact, it is possible to allow the microstrip actually to contact the top of the upside down resonator on the substrate because the TE mode field is not present in the top portion of the resonator that would contact the microstrip. Accordingly, the TE mode field can be positioned much closer to the microstrip than previously possible and, therefore, much better coupling is achieved without degrading the unloaded Q.

BRIEF DESCRIPTION OF THE DRAWINGS

FIGS. 12A-12H are cross sectional views of dielectric resonators that illustrate the effect of the center frequency of the TE and $H_{11}$ modes of tuning for conventional cylindrical dielectric resonators as well as conical resonators in accordance with the present invention.

DETAILED DESCRIPTION OF THE INVENTION

Figure 5:
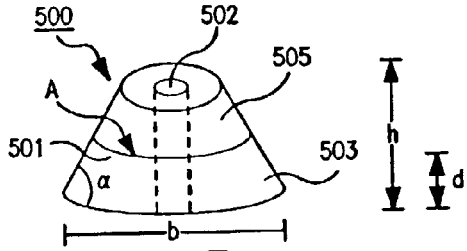
FIG. 5 is a perspective view of a dielectric resonator in accordance with the present invention.
Figure 3A:
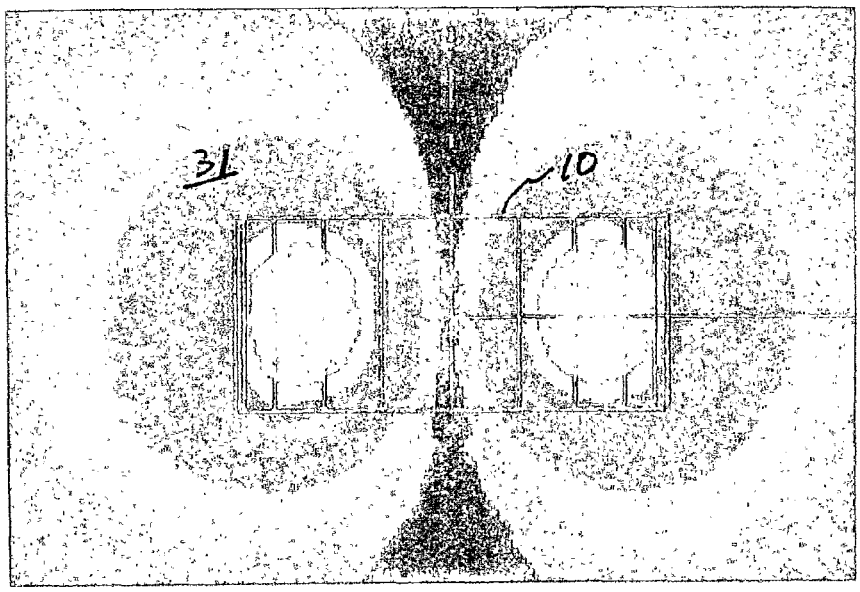
FIG. 3A is a cross sectional diagram of a cylindrical resonator of the prior art illustrating the distribution of the TE mode electric field.
Figure 3B:
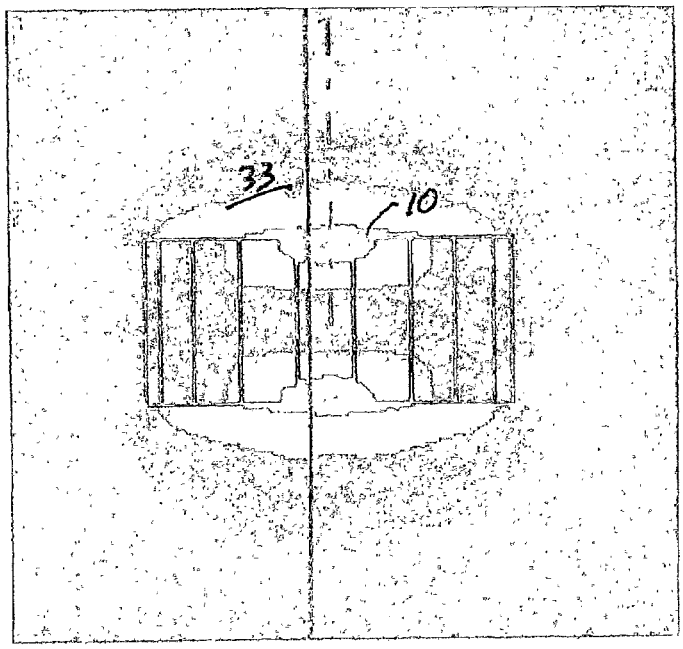
FIG. 3B is a cross sectional diagram of a cylindrical resonator of the prior art illustrating the distribution of the $H_{11}$ mode electric field.

FIG. 5 is a perspective view of a dielectric resonator in accordance with the present invention. As shown, the resonator 500 is formed in-the shape of a truncated cone 501 with a central longitudinal through hole 502. The conical shape physically separates the TE mode field from the $H_{11}$ mode field. As in the prior art, the primary purpose of the through hole is to suppress the Transverse Magnetic (TM) mode, which is another dangerous, spurious mode. The TM mode is the only mode not affected by the conical shape of the resonator in accordance with the present invention. Its frequency may be near the TE mode frequency. Therefore, the through hole in the conical resonators in accordance with the present invention should be designed with the appropriate diameter to completely suppress the TM mode.

Figure 6A:
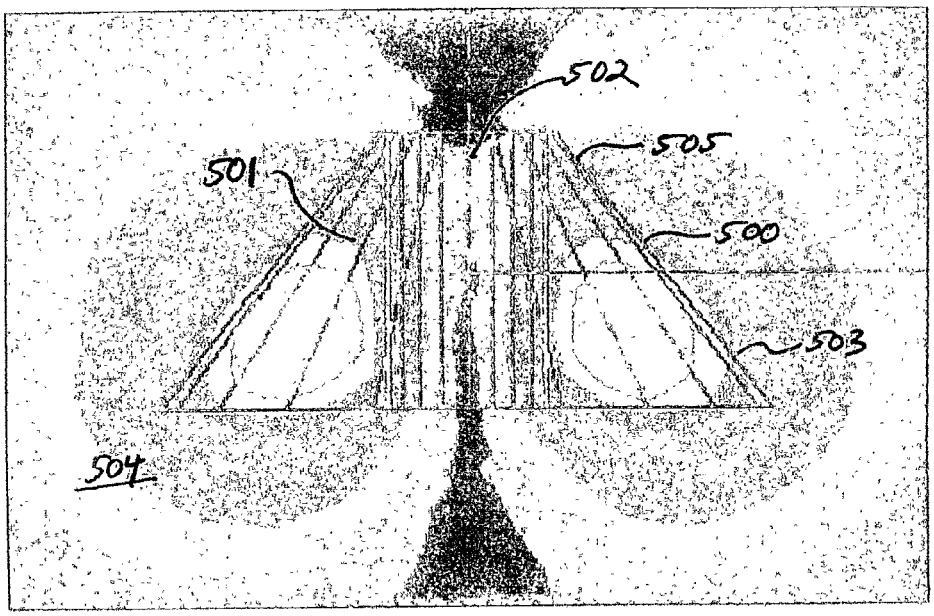
FIG. 6A is a cross sectional view of a dielectric resonator in accordance with the present invention illustrating the distribution of the TE mode electric field.
Figure 6B:
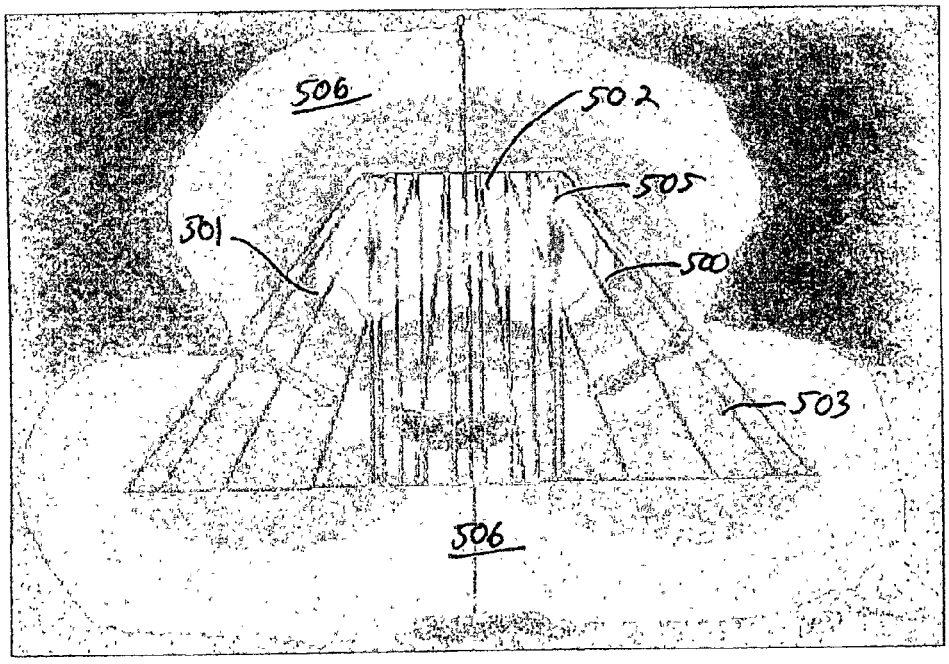
FIG. 6B is a cross sectional view of a dielectric resonator in accordance with the present invention illustrating the distribution of the $H_{11}$ mode electric field.

Referring to FIGS. 6A and 6B, the TE mode electric field 504 FIG. 6A) tends to concentrate in the base 503 of the resonator because of the transversal components of the electric field while the $H_{11}$ mode electric field 506 (FIG. 6B) tends to concentrate at the top (narrow portion) 505 of the resonator because of the vertical components of the electric field. The longitudinal displacement of these two modes improves performance of the resonator (or circuit employing such a resonator) because conical resonators can be positioned adjacent other microwave devices (such as other resonators, microstrips, tuning plates, and input/output loops) so that their TE mode electric fields are close to each other while their $H_{11}$ mode electric fields are further apart from each other. Accordingly, the $H_{11}$ mode would not couple to the adjacent microwave device nearly as much as when the TE mode and the $H_{11}$ mode are closer to each other.

In addition, the mode separation (i.e., frequency spacing) is much increased in the conical resonators of the present invention.

The radius of the longitudinal hole can be selected to optimize insertion loss, volume, spurius response and other properties. Further the radius of the longitudinal hole can be variable, such as comprising one or more steps.

Figure 7:
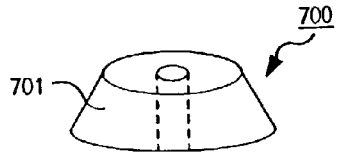
FIG. 7 is a side cross sectional view of a dielectric resonator in accordance with another embodiment of the present invention.

However, FIG. 7 shows an even more preferred embodiment of the invention in which the body 701 of the resonator 700 is even further truncated. Particularly, relative to the exemplary resonator illustrated in FIG. 5, one may consider the resonator of FIG. 7 to have its top removed. More particularly, the portion of the resonator in which the $H_{11}$ mode field was concentrated in the FIG. 5 embodiment is eliminated in the FIG. 7 embodiment. Accordingly, not only is the $H_{11}$ mode physically separated from the TE mode, but it is substantially attenuated to the point where it is almost non-existent relative to the magnitude of the TE mode field.

Hence, in contrast to the prior art, the problematic $H_{11}$ interference mode is substantially eliminated with virtually no incumbent attenuation of the TE mode.

As will be discussed further below in connection with the construction of filters and other circuits using the conical resonators of the present invention, the larger mode separation combined with the physical separation of the TE and $H_{11}$ modes enables the tuning of the center frequency of the TE mode without altering or, at least, without significantly affecting, the center frequency of the $H_{11}$ mode.

Figure 8:
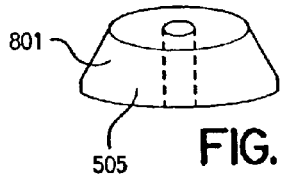
FIG. 8 is a perspective view of a dielectric resonator in accordance with another embodiment of the present invention.

FIG. 8 illustrates another embodiment of a resonator 800 in accordance with the present invention. In this embodiment, the radially outermost portion of the base 805 of the conical resonator body 801 is trimmed off so that the bottom of the resonator has a rectangular profile rather than a triangular profile. The resonator can be so modified without affecting the TE mode because only a small portion, if any, of the TE field mode is concentrated in the lower, outermost corner of the resonator (see FIG. 6A).

This embodiment has several advantages. For instance, it further reduces the size of the resonator and circuits employing the resonators. Also, it allows more of the TE mode field to exist outside of the dielectric material and thus allows for even stronger coupling to other microwave devices, such as other resonators, microstrips and coupling loops.

Figure 9A:
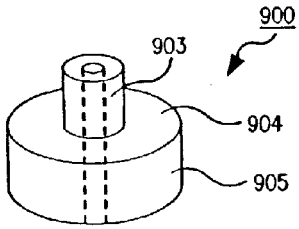
FIG. 9A is a perspective view of a dielectric resonator in accordance with a third embodiment of the present invention.

FIG. 9A is a perspective view of another embodiment of a dielectric resonator 900 in accordance with the present invention. In this embodiment, the resonator body 901 is stepped and substantially comprises an upper cylinder 901 having a smaller radius and a lower cylinder 903 having a larger radius. This configuration has a similar effect as the configuration shown in FIG. 5 in that it longitudinally displaces the $H_{11}$ mode from the TE mode. Particularly, the $H_{11}$ mode appears in and adjacent the upper smaller cylinder 903 while the TE mode is concentrated in the lower, wider portion 903 of the resonator.

Figure 9B:
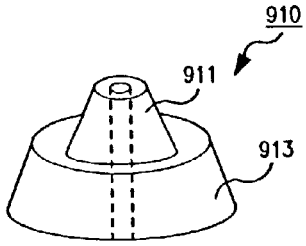
FIG. 9B is a perspective view of a dielectric resonator in accordance with a fourth embodiment of the present invention.

In another embodiment, the resonator 910 may comprise a stepped cone generally comprising two discontinuous truncated conical portions 911 and 913, as illustrated in FIG. 9B. This design provides similar mode separation characteristic as discussed above in connection with FIG. 5.

Figure 9C:
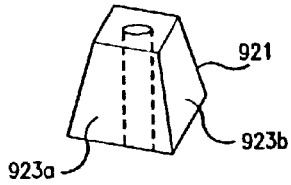
FIG. 9C is a perspective view of a dielectric resonator in accordance with a fifth embodiment of the present invention.
Figure 9D:
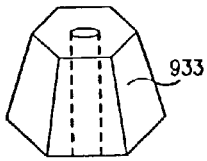
FIG. 9D is a perspective view of a dielectric resonator in accordance with a sixth embodiment of the present invention.
Figure 9E:
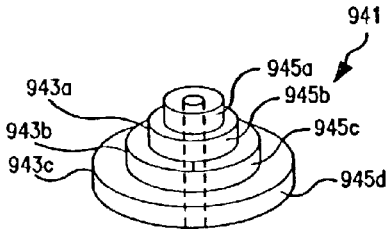
FIG. 9E is a perspective view of a dielectric resonator in accordance with a seventh embodiment of the present invention.

A substantial portion of the benefit of the present invention is derived from the change in size in the resonator as a function of height. Accordingly, resonators of many shapes other than a pure cone can provide most, if not all, of the benefits associated with the present invention. For instance, the sloped side of the resonator may comprise multiple planar walls rather than one continuous conical wall. Specifically, a resonator in accordance with the present invention may be formed as a truncated pyramid 921 (i.e. comprising four sloped, planar side walls 923*a*, 923*b*, 923*c*, 923*d*) as shown in FIG. 9C, or a truncated hexagonal pyramid 933 as shown in FIG. 9D. Even further, while FIG. 9A illustrates a stepped cylinder having a single step (i.e., two cylinder portions), the resonator may have any number of steps. FIG. 9E, for instance shows an embodiment of a resonator 941 with three steps 943*a*, 943*b*, 943*c* (i.e., four cylinders 945*a*, 945*b*, 945*c*, 945*d* of increasingly larger diameter). This same extension can be applied to the stepped cone embodiment shown in FIG. 9B. That is, while FIG. 9B shows two cone portions separated by a step, there may be any number of cone portions separated by steps. Even further, in any of the aforementioned sloped side wall embodiments, the outer portion of the wall at the bottom of the resonator may be squared-off in the manner illustrated in the FIG. 8 embodiment.

Furthermore, as discussed above, the purpose of the longitudinal through hole generally is to suppress the TM mode. In applications in which suppression of the TM mode is not of paramount importance, the longitudinal through hole may be eliminated.

A key aspect of the present invention is that the cross-sectional area of the resonator parallel to the electric field lines of the TE mode (i.e., the horizontal direction in all of the Figures) has an area that varies in the direction perpendicular to the field lines of the TE mode (i.e., the vertical direction or height in all of the Figures). Preferably, and in all of the embodiments discussed so far, the cross-sectional area varies monotonically as a function of height. Stated in less scientific terms, the amount of dielectric material in the resonator assembly decreases as a mathematical function of height. For instance, in the right conical resonator illustrated in FIG. 5, the area of dielectric material varies monotonically (particularly, it decreases) as a function of height in accordance with the formula:

$$A=\Pi(b/2-d/\tan(\alpha))^2$$

where A=horizontal cross-sectional area of the resonator b=diameter at the base of the conical resonator;

d=a given distance from the base of the cone in the direction of the height h, of the conical resonator; and α=angle of the side wall of the cone to the base of the cone.

In the stepped cylindrical embodiments shown in FIGS. 9A and 9E, the area is constant over portions of the height, but decreases in discrete steps as one moves upwardly (and thus the aforementioned cross-sectional area decreases mononically as a function of height). As another example, in the stepped conical embodiment illustrated in FIG. 9B, the area of the dielectric material decreases with height generally according to the above formula for a cone, but with slight modifications that would be readily apparent to those of skill in geometry to account for the discrete steps. In the conical embodiment illustrated by FIG. 8 in which the bottommost, outermost portion is cut off, the cross-sectional area is constant over a small portion of the height at the bottom of the resonator and then decreases generally in accordance with the above formula for a cone.

Figure 9F:
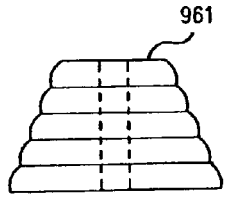
FIG. 9F is a perspective view of a dielectric resonator in accordance with an eighth embodiment of the present invention.

As mentioned above, it is not even a requirement that the variation in cross-sectional area as a function of height be truly monotonic, but just that the cross-section generally varies in one direction (e.g., decreases) as a function of height. For instance, FIG. 9F shows an embodiment in which the resonator 961 is generally in the shape of a beehive in which the resonator's horizontal cross-sectional area generally decreases with increasing height, but includes portions where the cross-sectional area increases over small height increments.

Resonators in accordance with the present invention can be used in various circuits, especially microwave circuits, including microwave filters, oscillators, triplexers, etc.

Figure 10:
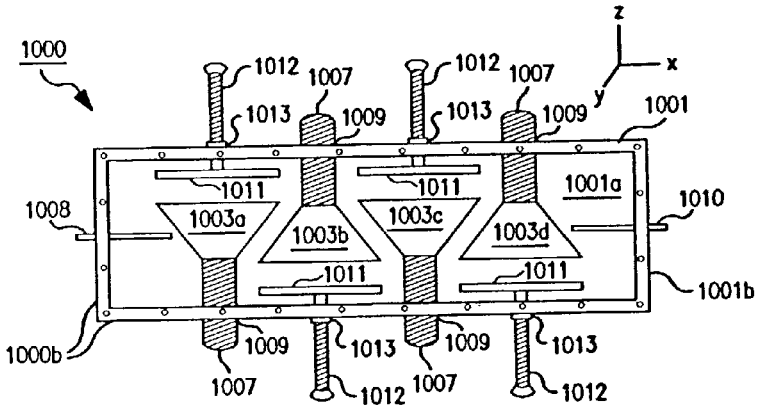
FIG. 10 is a perspective view of a microwave filter employing dielectric resonators in accordance with a first embodiment of the present invention.

FIG. 10, for instance, shows an exemplary microwave filter constructed with conical resonators in accordance with the present invention. In at least one preferred embodiment, the resonators have a dielectric constant of at least 45 and is formed of barium tatinate. As shown, the filter 1000 comprises an enclosure 1001 having a bottom 1001*a*, a side wall 1001*b*, and a top wall (shown as transparent for purposes of illustrating the internal components) to form a complete enclosure. The enclosure 1001 of FIG. 10 is rectangular and the resonators are arranged so that their longitudinal axes are parallel to each other, but not collinear, and they are all generally near the same plane perpendicular to their longitudinal axes. Although, as will be discussed in detail below, the positions of the resonators preferably are adjustable longitudinally, and therefore, the resonators may not be in the same plane perpendicular to their longitudinal axes, but generally will be close thereto. However, the shape can be varied. A plurality of resonators 1003 are arranged within the housing in any configuration suitable to achieve the performance goals of the circuit. Preferably, each resonator is longitudinally inverted relative to its adjacent resonator or resonators. Thus, resonator 1003*a* is upside down, resonator 1003*b* is right side up, resonator 1003*c* is upside down, etc.

The microwave energy may be coupled into the system through any reasonable means known in the prior art or discovered in the future, including by forming microstrips on a surface of the enclosure or by use of coupling loops as described in the background section of this specification. In this particular embodiment, microwave energy supplied from a coaxial cable 1005 is coupled to an input coupling loop 1008 to be described in greater detail in connection with FIG. 13 positioned near the first resonator 1003*a* and the output is received at an output coupling loop 1010 positioned near the last resonator 1003*d*.

Figure 1:
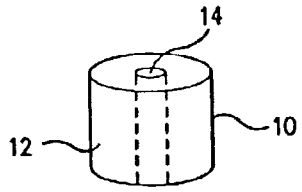
FIG. 1 PRIOR ART
FIG. 1 is a perspective view of a cylindrical dielectric resonator of the prior art.
Figure 2:
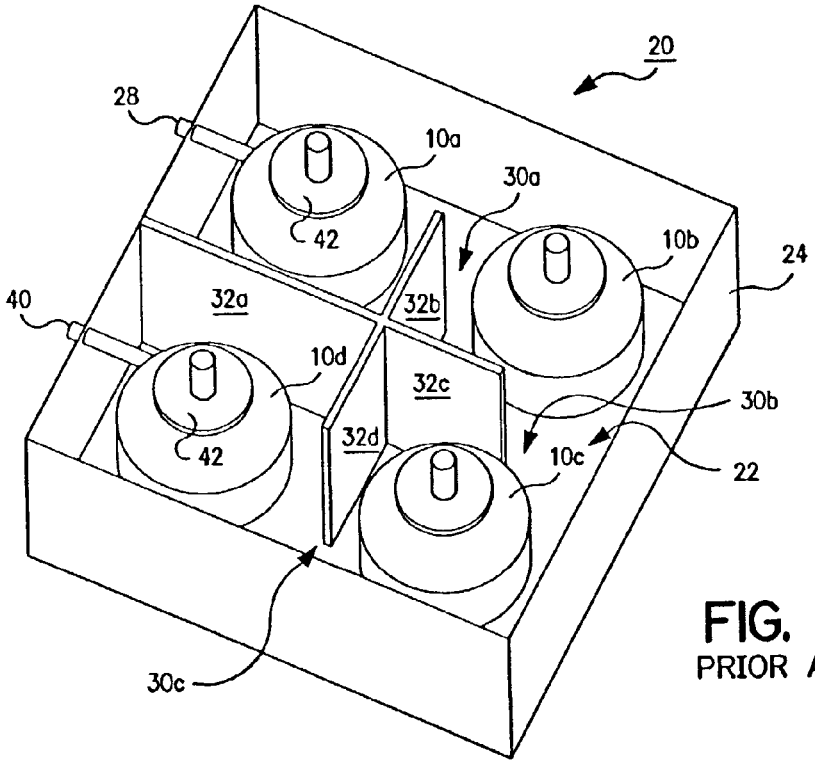
FIG. 2 PRIOR ART
FIG. 2 is a perspective view of an exemplary microwave dielectric resonator filter of the prior art.
Figure 4:
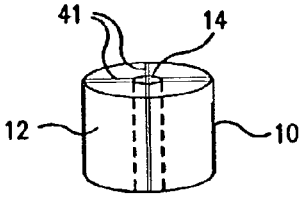
FIG. 4 is a perspective view of a dielectric resonator of the prior art similar to FIG. 1 except further including metal strips for suppressing the $H_{11}$ mode in the resonator.

In this design, all of the resonators are arranged in a line. Hence, no additional separating walls are necessary to prevent unwanted cross-coupling between resonators. However, depending on size, shape and other conditions, it may be desirable to arrange the resonators in other patterns, such as the pattern illustrated in prior art FIG. 2, that require separating walls to prevent cross-coupling between resonators that should not cross-couple and/or to control coupling for achieving narrow band filters. On the other hand, in some circuits it may be desirable for additional cross coupling to occur, in which case there may be no need for additional separating walls.

The primary reason for the preference of inverting each resonator relative to the adjacent resonators is so that the TE mode electric fields can be brought even closer to each other and to reduce the size of the filter. For instance, the resonators can be packed much more tightly in this manner, as can be seen in FIG. 10. In addition, the bandwidth of the filter can be adjusted over a much greater range by manipulating spacing of the resonators to each other (and thus the coupling of the resonators to each other). In addition, the position of the TE mode field of the resonator places more of the field at and beyond the circumference of the resonator so that the fields of adjacent resonators can be bought even closer. Even furthermore, this arrangement of resonators allows for the position of the TE mode fields of adjacent resonators to be adjustable with three degrees of freedoms (i.e., the positions of the fields relative to each other can be adjusted in three dimensions), whereas, in the prior art, there were only two degrees of freedom). Particularly, because the TE mode fields are concentrated in the bases of the resonators, the field of one resonator is displaced longitudinally (the z axis in FIG. 10) as well as transversely (the x and y axes) of the field of the adjacent resonator. For instance, if the resonators are spaced very closely to each other in the transverse direction, the base of one resonator may be positioned almost directly above the base of an adjacent resonator such that there is no transverse displacement between the bases of the two resonators, only a longitudinal displacement. On the other hand, of course, resonators could be spaced further apart in the transverse direction so that there is both a transverse and a longitudinal displacement between the bases (and thus the TE mode field concentrations).

Accordingly, the TE mode field of one resonator can be placed right above the TE mode field of another resonator if strong coupling is desired. On the other hand, if less coupling is desired, the displacement between the two resonators can be adjusted longitudinally and/or traversely.

In the preferred embodiment of the invention illustrated in FIG. 10, the displacement of the resonators relative to each other is fixed in the transverse direction upon assembly, but is adjustable in the longitudinal direction after assembly. Particularly, the resonators 1003 are mounted on screws 1007 which are screwed into threaded holes 1009 in side walls 1001*b* of the enclosure. Alternately, the holes 1009 can be blind holes. The resonators 1003 also may be adjustably mounted on the screws 1007. Particularly, the longitudinal central holes 1005 in the resonators 1003 are also threaded to mate with the screws 1007. Accordingly, by rotating the screw 1007 relative to one or both of the holes in the enclosure 1001 or the longitudinal holes in the resonators 1003, the longitudinal positions of the resonators relative to each other can be adjusted easily.

In a preferred embodiment, however, the resonators are fixedly mounted to the screws and the screws are rotatable only within the holes in the enclosure. If the holes in the enclosure are through holes, the resonator spacing, and thus the bandwidth of the filter, can be adjusted without even opening the enclosure 1001 simply by rotating the screws that protrude from the enclosure. Since there are no irises, coupling screws, or separating walls between the resonators, and the design of the resonators and the system inherently provides for wide flexibility of coupling between adjacent resonators, a system can be easily designed in which the enclosure 1001 plays no role in the electromagnetic performance of the circuit. Accordingly, instead of being required to fabricate the housing extremely precisely and out of a conductive material (e.g., metal) in order to provide suitable electromagnetic characteristics, the enclosure can now be fabricated using low-cost molding or casting processes, with lower cost materials and without the need for precision or other expensive milling operations, thus substantially reducing manufacturing costs. In addition, the screws 1007 for mounting the resonators in the enclosure also can be made out of a non-conducting material and or without concern for their effect on the electromagnetic properties of the system. A filter constructed in accordance with the general principals of the invention such as illustrated in FIG. 10 should be able to provide bandwidth selectivity from below 3 MHz to over 120 MHz at a center frequency of 1 GHz depending on the positioning of the resonators relative to each other.

The system further includes circular conductive tuning plates 1011 adjustably mounted on the enclosure 1001 so that they can be moved longitudinally relative to the bases of the resonators 1003. As in the prior art, these tuning plates are used to adjust the center frequency of the TE mode of the resonators, and thus the system. These plates may be mounted on non-conductive screws 1012 that pass through holes 1013 in the enclosure 1001 to provide adjustability after assembly. The plates 1011 are essentially similar to the plates 42 discussed above in connection with FIG. 2 and require no further discussion.

With reference to FIG. 6B, which shows the $H_{11}$ mode field strength in a conical resonator in accordance with the present invention, note that the $H_{11}$ field is very weak beneath the base of the resonator, particularly near the longitudinal center of the resonator. Thus, as previously noted, because of the mode separation between the TE and the $H_{11}$ modes and the physical separation of the TE and $H_{11}$ modes, it is possible to tune the center frequency of the TE mode in the conical resonators of the present invention with very little effect on the $H_{11}$ mode. Any effect of TE mode center frequency tuning on the $H_{11}$ mode can be even further reduced or eliminated by making the tuning plate, such as tuning plate 1011 in FIG. 10 of a small radius, such as slightly larger than the radius of the longitudinal through hole of the resonator. By making the tuning plate smaller, the plate can primarily remain outside of the $H_{11}$ mode field yet still extend significantly into stronger portions of the TE field and, thus, still significantly affect it. In one preferred embodiment of the invention, the tuning plate has a radius smaller than the base of the resonator, but larger than the radius of the through hole. The particular, optimal size of the plate depends largely on the angle of the sloped side wall of the conical resonator. In at least one preferred embodiment of the invention, the conical resonators have a 40° slope. With a 40° slope, it has been found that a circular plate of approximately 130%-150% of the diameter of the central through hole is quite effective.

The screws 1007 upon which the resonators are mounted and/or the screws 1012 upon which the tuning plates are mounted can be coupled to electronically controlled mechanical rotating means to remotely tune the filter. For instance, the screws 1007, 1012 can be remotely controlled to tune the filter using local stepper motors and digital signal processors (DSP) that receive instructions via wired or wireless communication systems. The operating parameters of the filter may be monitored by additional (DSPs) and even sent via the wired or wireless communication system to a remote location to affirm correct tuning, thus forming a truly remote-controlled servo filter.

The aspect of the present invention of mounting the resonators and/or the tuning plates on screws so that they can be longitudinally adjustable for center frequency and bandwidth tuning can be applied to conventional, cylindrical dielectric resonators. For instance, the conical resonators 1003*a*, 1003*b*, 1003*c*, and 1003*d* in FIG. 10 can be replaced with a conventional cylindrical resonators. Although, performance in almost every respect, including tuning, would be inferior to the filter of FIG. 10 using conical resonators, it would work for narrow band filters, e.g., having bandwidths of less than about 10 mHz. Longitudinal adjustment of the cylindrical resonators relative to each other would affect the field coupling and thus the bandwidth of the filter. Likewise, longitudinal adjustment of the tuning plates would affect the center frequency of the TE mode. Accordingly, this aspect of the invention is useful in connection-with conventional cylindrical dielectric resonators also.

FIG. 11 A is a perspective view of another dielectric resonator microwave filter 1100 constructed in accordance with the principals of the present invention. As can be seen in the figure, the filter 1100 comprises a plurality of conical resonators 1102 arranged in a radial pattern inside a generally cylindrical enclosure 1104. As shown, the cylindrical enclosure is an annulus with an inner radial wall 1104*a* and an outer radial wall 1104*b*. The resonators are arranged such that their longitudinal axes 1103*a* intersect at the point defining the center of the radial pattern.

The system generally includes the same basic components as the filter shown in FIG. 10. Particularly, it includes an input coupling element 1120 positioned adjacent the first resonator 1102*a* and an output coupling element 1122 positioned adjacent the last resonator 1102*d*. It also includes adjusting screws 1106 adjustably mounting the resonators 1102 to the enclosure 1104. The screws 1106 are plastic, threaded screws that mate with threaded through holes (not visible in FIG. 11) in the inner radial side wall 1104*a* of enclosure 1104 so that the positions of the resonators can be adjusted along their longitudinal axes from without the enclosure. In addition, conductive adjusting plates 1110 are mounted parallel to the bases of the resonators 1102. In a preferred embodiment of the invention, they are adjustably mounted to the enclosure via non-conductive adjusting screws 1112 which pass through threaded through holes 1114 in the outer radial side wall 1104*b* of the enclosure 1104. As previously described, the position of the conducting plates 1110 help set the center frequency of the resonators and, thus, the filter system. Because the adjusting screws pass through through holes in the enclosure, the center frequency and the bandwidth of the filter can be adjusted without opening the enclosure.

Due to the fact that coupling between the resonators in this radial type configuration can be so strong, inner separating walls 1116*a*, 116*b*, 116*c*, and 116*d* with irises 1118*a*, 1118*b*, 1118*c* may be desirable. Separating wall 1116*d* does not have an iris because it separates the first resonator from the last resonator in the coupling sequence and those resonators are not suppose to couple with each other at all. Further, it may be desirable to have coupling adjusting screws 1120*a*, 1120*b*, and 1120*c* within the irises to help reduce coupling between resonators.

The separating walls 1116*a*, 1116*b*, and 1116*c* with irises 1118*a*, 1118*b*, 1118*c* and/or adjusting screws 1120*a*, 1120*b*, 1120*c* would most likely be desirable in filter systems that have relatively low bandwidth. However, for very wide bandwidth applications, in which very strong coupling between the resonators is desired, there may be no need for separating walls 1116*a*, 1116*b*, 1116*c* and the corresponding irises and adjusting screws. Of course, separating wall 1116*d* would still be desirable since resonators 1102*a* and 1102*d* are not intended to couple with each other. With this radial configuration, it is possible to reach bandwidths of 240 MHz or more at a central frequency of 1 GHz.

Figure 11A:
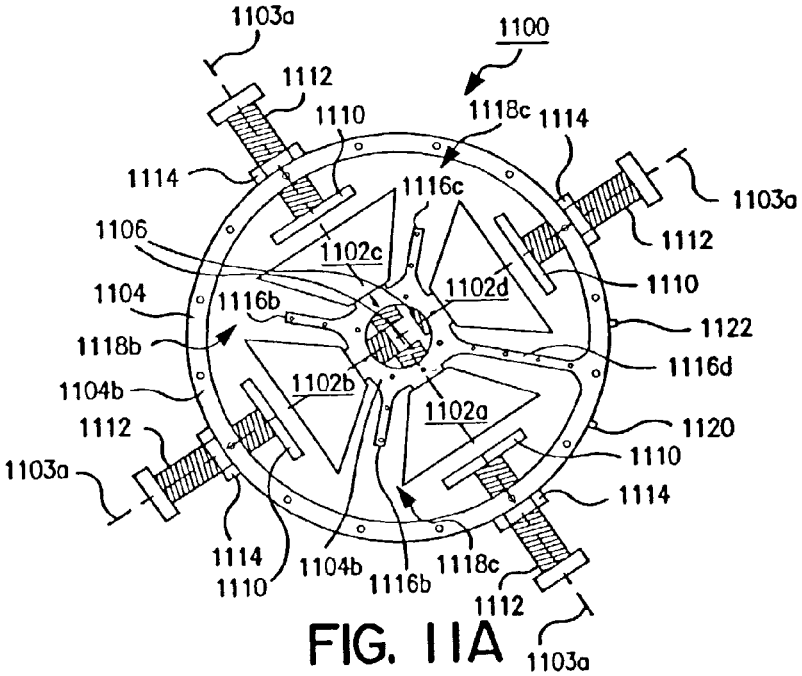
FIG. 11A is a perspective view of a microwave filter employing dielectric resonators in accordance with another embodiment of the present invention.

While the embodiment illustrated in FIG. 11A includes four resonators arranged at intervals at 90° and with side wall slopes of approximately 45° such that the side walls of adjacent conical resonators are parallel to each other, these features are merely exemplary of a preferred embodiment. A radial dielectric resonator filter system can be developed with any number of resonators at any angle to each other and with any side wall slopes.

Figure 11B:
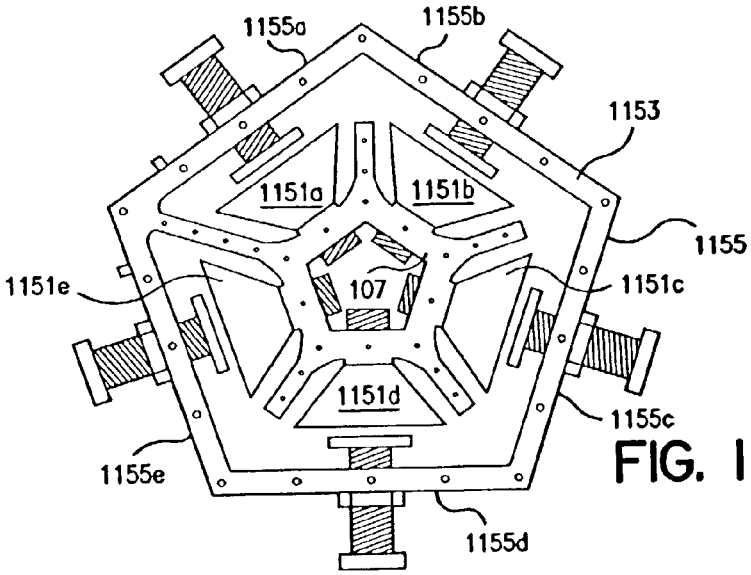
FIG. 11B is a perspective view of a microwave filter employing dielectric resonators in accordance with another embodiment of the present invention.

Alternately, the enclosure can be shaped as any equilateral polygon, e.g., a square, a pentagon, a hexagon, an octagon, with an inner wall and an outer wall. FIG. 11B illustrates a pentagonal filter circuit having five conical resonators 1151*a*, 1151*b*, 1151*c*, 1151*d*, 1151*e* and accompanying accoutrements such as plates and mounting screws (not labeled with reference numbers in order not to obfuscate the feature being described herein) and an enclosure 1153 comprised of an outer wall 1155 having five equal segments 1155*a*, 1155*b*, 1155*c*, 1155*d*, 1155*e* and an inner wall 1157 similarly having five equal segments. In fact, while it would be the most practical design, it is not even necessary that the polygon be equilateral. In fact, mathematically, an annulus is an equilateral polygon having an infinite number of sides. If the enclosure is not an annulus, then the number of sides of each of the inner and outer walls normally would be equal to the number of resonators in the circuit.

Figure 11C:
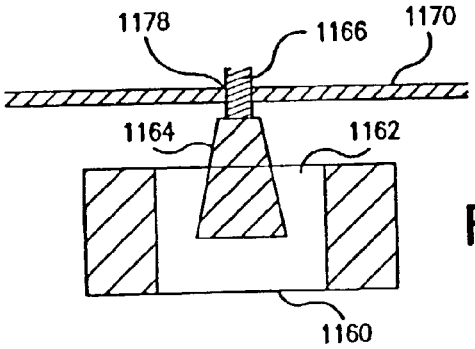
FIG. 11C is a cut-away cross-sectional view of a portion of a microwave filter in accordance with another embodiment of the present invention.

FIG. 11C illustrates an even further embodiment of the present invention. FIG. 11C is a cut-away cross-sectional view of a single dielectric resonator assembly (e.g., the resonator, tuning plate and corresponding mounting screws) that can be used as a replacement for any of the single dielectric resonator assemblies shown in FIGS. 10, 11A and 11B. In this embodiment, the dielectric resonator puck 1160 is cylindrical with a longitudinal, central through hole 1162. A truncated conical tuning element 1164 is mounted so as to fit within the through hole 1162 of the puck 1160. Either the puck 1160, the tuning element 1164, or both are adjustably mounted so that the extent to which the tuning element is within the through hole can be adjusted in order to adjust the central frequency of the TE mode within the assembly. As in the embodiments illustrated in FIGS. 10, 11A and 11B, the puck and/or the tuning element can be mounted on dielectric screws that, in turn, are mounted in through holes in the enclosure. FIG. 11C illustrates an embodiment in which the puck is stationary and the tuning element 1164 is mounted on a screw 1166 that, in turn, is mounted in a through hole in a wall 1170 of the enclosure. However, this is merely exemplary. Just as in the case of the conical resonator, the conical tuning element causes the TE mode and the $H_{11}$ mode to be physically separate within the assembly.

By providing movable conical resonators, the present invention provides a controlled strong coupling, whereby lowpass or highpass filters can be replaced with very broad bandpass or very broad band-stop filters that are almost lossless. If very broad band filters are needed, this configuration provides a very compact design with extremely high Q (almost lossless).

Presently available conventional filters can achieve broadest bands of not more than about 75 MHz. This is achieved with combline filters or cavity filters, rather than dielectric resonator filters. It is very difficult to achieve bands broader than about 30 MHz with conventional dielectric resonator filters.

Furthermore, filters in accordance with the present invention will only become better as materials with higher dielectric constants are developed. Specifically, as the dielectric constant of the resonator material increases and the size of the resonators decreases, the electric fields become more concentrated in smaller spaces, thus reducing the problem of undesired cross-coupling of fields and also allowing for smaller circuits. Unlike in prior art dielectric resonator circuits, in which tuning becomes more difficult as the dielectric constant increases, tuning remains manageable with respect to dielectric resonator circuits constructed in accordance with the present invention, thus enabling the construction of circuits with dielectric resonators formed of materials with extremely high dielectric constants.

Systems constructed in accordance with the principals of the present invention as disclosed in connection with FIGS. 11A and 11B can be fabricated with higher quality factors per unit volume. Higher electromagnetic fields outside the dielectric resonators allow for stronger coupling. Hence, compact, low loss filters can be developed for wireless, satellite and other communications systems. In this type of embodiment, the enclosure preferable is formed of a conducting metal. Particularly, as noted above, a conductive separating wall should be provided between at least the first and last resonators of the coupling sequence in order to prevent them from coupling to each other. Accordingly, that wall, e.g., wall 1116*d* should be conductive. The remainder of the enclosure may be non-conductive. However, as a practical matter, in most instances, it would be more economical to construct the enclosure from a single material.

While the exemplary systems shown in FIGS. 10, 11A and 11B are discussed in the context of microwave filters, the principals of the present invention can be applied to form other types of circuits, including oscillators, duplexers, triplexers, etc.

FIGS. 12A-12H are diagrams illustrating the field strengths of the TE and $H_{11}$ modes in conventional resonators and conical resonators in accordance with the present invention according to computer simulations. The simulations illustrate the effect of center frequency tuning of the TE mode using conductive plates, such as the tuning plates illustrated in FIGS. 10 and 11, on the center frequency of the $H_{11}$ mode. Particularly, these simulations demonstrate the superiority of the present invention in terms of tuning the TE mode while reducing side effects on the $H_{11}$ mode.

FIGS. 12A and 12B illustrate the field strengths of the TE and $H_{11}$ modes in a conical resonator 1201 in accordance with the present invention with a tuning plate 1203 positioned well out of the fields so as not to cause any tuning. In the particular circuit simulated, the TE mode has a center frequency of about 1.918 MHz, while the $H_{11}$ mode field has a center frequency of about 2.787 MHz. Thus, the mode separation between the TE and $H_{11}$ modes is almost 900 MHz. FIGS. 12C and 12D illustrate the TE and $H_{11}$ mode field strengths, respectively, for a conventional dielectric resonator 1211 with the tuning plate 1203 well out of the fields and responsive to the same stimulus as in FIGS. 12A and 12B. The TE mode has a center frequency of about 1.964 MHz, while the $H_{11}$ mode has a center frequency of about 2.692 MHz. Accordingly, mode separation between the TE and the $H_{11}$ modes is about 750 MHz. Accordingly, it can be seen that, even in the absence of any tuning, the conical resonators of the present invention provide superior mode separation compared to conventional dielectric resonators.

FIGS. 12E and 12F illustrate the TE and $H_{11}$ mode field strengths for resonator 1201 of FIGS. 12A and 12B, except with the tuning plate 1203 lowered so that it disturbs the TE mode field and, thus, tunes the center frequency for the TE mode. With the tuning plate so positioned, the center frequency of the TE mode has been pushed up from about 1.918 MHz to about 2.279 MHz, while the $H_{11}$ mode has been pushed up from about 2.787 MHz to about 3.027 MHz. Accordingly, the center frequencies of the TE mode and the $H_{11}$ mode have both moved in the same direction and are still 750 MHz apart.

However, referring now to FIGS. 12G and 12H, they show the TE and $H_{11}$ mode field strengths, respectively, for the conventional dielectric resonator 1211 of FIGS. 12C and 12D with the tuning plate 1203 positioned the same distance from the top surface of the cylindrical resonator as in FIGS. 12E and 12F and responsive to the same stimulus. The center frequency of the TE mode has been pushed up from about 1.964 MHz to about 2.256 MHz, while the $H_{11}$ mode center frequency has been pushed down from about 2.688 MHz to about 2.469 MHz. Accordingly, in the conventional design, the TE mode and the $H_{11}$ mode have moved in opposite directions, towards each other, and now have mode separation of only approximately 200 MHz. Hence, the superiority of the design of the present invention is readily apparent from the simulations illustrated in FIGS. 12A-12H.

Figure 13:
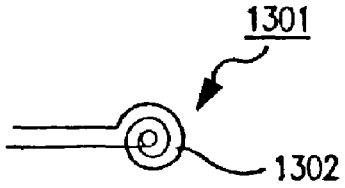
FIG. 13 is a perspective view of an exemplary input coupler for coupling a signal to a dielectric resonator in accordance with the present invention.

FIG. 13 is a plan view of the exemplary microwave loop coupler in accordance with another aspect of the present invention that is used in the exemplary circuit shown in FIG. 10. A coupler in accordance with this aspect of the present invention can be employed as either an input coupler or an output coupler for a dielectric resonator filter or other circuit constructed in accordance with the principals of the present invention. The primary distinction between the coupler 1301 illustrated in FIG. 13 and loop couplers of the prior art is the spiral configuration of the loop 1301. Particularly, in the prior art, the loops of the input and output couplers were formed as single loops. In accordance with this aspect of the present invention as illustrated in FIG. 13, the loop 1301 is formed as a substantially planar spiral. This aspect of the invention provides greater magnetic flux in a given physical volume, thus providing a stronger magnetic field for coupling to a resonator while not substantially increasing the volume occupied by the field. As previously noted, the coupling range of the input and output couplers is restricted by the fact that it is generally undesirable for the input coupler and the output coupler in a system to couple directly with each other. Accordingly, the volume of the coupling fields must be maintained in a compact volume in order to prevent the input and output coupling loops from coupling directly to each other and thus negatively affecting the frequency performance of the circuit.

This aspect of the invention is particularly suitable for use with conical resonators because a significant amount of the magnetic field is concentrated near the top of the resonator. Therefore, a printed circuit loop coupler as shown in FIG. 13 properly placed adjacent the top of the resonator will have good magnetic coupling regardless of how small the size of the printed circuit. Many loops (in the spiral) exposed to a strong magnetic field provide a strong coupling in a small volume. However, this will cause a degradation of Q due to the currents generated in the small volume of the spiral. For circuits in accordance with the present invention, in which the cavity can be made virtually lossless, a designer can afford to give up some Q for this kind of ease of coupling. The technique would not be particularly suitable in connection with conventional resonator circuits because use of this technique with conventional cylindrical resonators raises technical problems relating to the positioning of the spiral loop. Also, conventional resonators already have low Q and generally cannot afford the further degradation of the Q of the circuit that is likely with this technique.

Alternately, designs combining combline filters and dielectric resonator filters can be envisioned. In such a design, only the first and last resonators are cavity combline resonators while the intermediate resonators are conical resonators coupled without irises. This combined filter helps improve the spurious response without significantly degrading Q since the first and last combline resonators are cavity resonators that do not contribute significantly toward filter losses.

This technique, on the other hand, cannot readily be applied to conventional dielectric resonator circuits for several reasons. First, because they employ conductive enclosures and other components that significantly degrade the Q of the circuit, the additional degradation of Q to achieve this type of coupling may be unacceptable. Furthermore, there simply may not be a practical space in which a spiral loop coupler in accordance with the present invention can be placed relative to a conventional resonator. For instance, the loop coupler typically would need to be placed adjacent the top or bottom surface of the resonator to which it must couple in order to be within the strong magnetic field that runs vertically through the resonator in and out of the top and bottom surfaces. It typically should not be placed adjacent a side surface of the resonator, where the magnetic field is weak. However, it often is impractical to place a coupler near the top surface of the resonator, where a tuning plate is likely to be positioned. Also, unlike the circuits of the present invention, in which the resonators are suspended on screws within the enclosure, the dielectric resonators in conventional dielectric resonator circuits typically would be mounted directly on the bottom surface of the enclosure, such that the loop could not be placed under the resonator.

Figure 14:
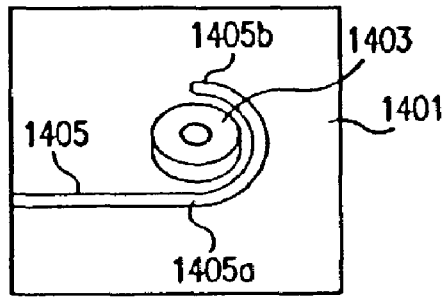
FIG. 14 PRIOR ART
FIG. 14 is a perspective view of a dielectric resonator of the prior art mounted on a substrate so as to provide coupling with a microstrip in accordance with the prior art.
Figure 15A:
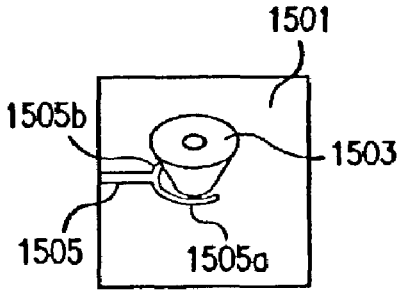
FIGS. 15A and 15B are perspective and side views, respectively, of a dielectric resonator mounted on a substrate so as to provide coupling with a microstrip in accordance with the present invention.
Figure 15B:
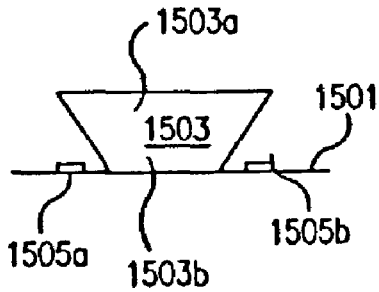

FIGS. 14, 15A and 15B illustrate another aspect of the present invention relating to field coupling between resonators and microstrips. FIG. 14 is an overhead plan view of a substrate 1401 bearing a dielectric resonator and a microstrip 1405 for electromagnetic coupling to the resonator in accordance with the prior art. The substrate 1401 may be the bottom surface of an enclosure for a dielectric resonator microwave filter such as discussed above in connection with FIG. 2. Alternately, it may be a printed circuit board (PCB) or any other substrate on which a dielectric resonator may be mounted as part of a system.

As can be seen in the figure, dielectric resonator 1403 is mounted on the substrate 1401 in any reasonable manner, such as by adhesive. The substrate bears a microstrip 1405 that is coupled at one end to a signal source or signal destination (not shown). The opposite end is adapted to electromagnetically couple with an electric field of the resonator. In this particular example, the microstrip 1405 forms an arc around the resonator 1403. The microstrip should not contact the resonator since, in this type of resonator, the desired TE mode electric field as well as the undesired $H_{11}$ mode electric field are both adjacent the substrate. Physically contacting the resonator with the microstrip where those fields exist would lead to undesirable electromagnetic side effects. Particularly, if the height of the standard resonator is small, then physically contacting the microstrip could suppress the TE mode because the metal of the strip forces the electric field of the mode to zero. Even if the resonator is relatively tall, physically contacting the resonator (to increase the coupling) would change the boundary conditions and trigger a redistribution of the fields inside the resonator. This represents a distorted, non-symmetric resonance and a degraded unloaded Q. Accordingly, the coupling strength between the resonator and the microstrip is limited.

FIGS. 15A and 15B are perspective and elevation views, respectively, of a substrate bearing a dielectric resonator and a microstrip for electromagnetic coupling to the resonator in accordance with the present invention. The resonator 1503 is mounted on the substrate 1501 upside down (i.e., with the narrow end or top 1503*b* contacting the substrate). A microstrip 1505 is formed on the substrate. One end of the microstrip is coupled to a signal source or destination (not shown). The other end is adapted to electromagnetically couple to the conical resonator 1503. Particularly, the microstrip is split into two legs 1505*a* and 1505*b* that form arcs partially around the top of the resonator. Since the resonator 1503 is conical and mounted upside down on the substrate, the two legs 1505*a*, 1505*b* of the microstrip can be positioned directly beneath the base 1503*a* of the resonator. Since, as previously noted, the TE mode electric field is concentrated in the base 1503*a* of the dielectric resonator, it is positioned directly above the microstrip 1505, thus providing superior coupling with the microstrip relative to the conventional design illustrated in FIG. 14. The conical resonators of the present disclosure provide an excellent combination of undisturbed resonance with a high unloaded Q and very strong coupling to the microstrip.

Further, because the TE mode electric field is concentrated in the base 1403*a* of the resonator, the microstrip 1405 actually may contact the top of the resonator, if desired, because the TE mode electric field does not exist near the top of the resonator. In addition, the $H_{11}$ mode is substantially eliminated if the cone is suitably truncated and, thus, is not an issue. Hence, even if the microstrip contacts the top of the resonator, it will not have a significant adverse effect on the desired TE mode fields. When the resonator is very small (for example, when the operating frequency is very high, such as 20 GHz or higher), the mode separation is very good and the presence of $H_{11}$ is not a problem. The only concerns at high frequencies are the electrical properties of the TE mode, which are greatly improved by the use of conical resonators.

We have disclosed new dielectric resonator designs as well as circuit system designs employing such resonators, including new techniques for coupling resonators to other resonators and to other system elements, such as microstrips and coupling loops. The resonator and circuit designs disclosed herein provide numerous and significant advantages over the prior art, including, physical separation of the TE and $H_{11}$ modes, virtual elimination of the $H_{11}$ mode, higher quality factors, more compact circuits and resonators, stronger coupling, and greater adjustability and range of coupling (and, thus, greater adjustability and range of bandwidth of circuits). Further, the invention eliminates the need for high-precision-machined conductive enclosures and other components, such as coupling screws. We also have disclosed new designs for loop couplers that increase field strength without increasing field volume and new designs for coupling fields between resonators and microstrips.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator formed of a dielectric material adapted to resonate electromagnetically in response to electromagnetic excitation, said dielectric resonator including a longitudinal through hole, said dielectric resonator varying monotonically in cross-sectional area perpendicular to said longitudinal direction as a function of said longitudinal direction, wherein said dielectric resonator comprises a cone.

2. The dielectric resonator of claim 1 wherein said dielectric resonator comprises a truncated cone.

3. The dielectric resonator of claim 1 wherein said dielectric material is barium titanate.

4. The dielectric resonator of claim 1 wherein said dielectric material has a dielectric constant of greater than about 45.

5. The dielectric resonator of claim 1 wherein said dielectric resonator comprises a cylindrical bottom portion and a conical upper portion.

6. The dielectric resonator of claim 1 wherein said dielectric resonator comprises a stepped cone.

7. A dielectric resonator formed of a dielectric material, said dielectric resonator including a longitudinal through hole, said dielectric resonator varying monotonically in cross-sectional area perpendicular to said longitudinal direction as a function of said longitudinal direction, wherein said dielectric resonator comprises at least two discontinuous truncated cones.

8. A dielectric resonator formed of a dielectric material adapted to resonate electromagnetically in response to electromagnetic excitation, said dielectric resonator body including a longitudinal through hole, said dielectric resonator body varying monotonically in cross-sectional area perpendicular to said longitudinal direction as a function of said longitudinal direction, wherein said dielectric resonator comprises a plurality of sloped planar side walls.

9. The dielectric resonator of claim 8 wherein said dielectric resonator comprises a pyramid.

10. The dielectric resonator of claim 8 wherein said dielectric resonator comprises a hexagonal pyramid.

11. A dielectric resonator comprising a body formed of a dielectric material, said body including a longitudinal through hole, said body comprising a plurality of sequentially stacked annular portions, each annular portion having a diameter smaller than the diameter of a preceding annular portion in said sequence wherein said annular portions are torroidal in shape.

12. A dielectric resonator comprising a body formed of a dielectric material and adapted to resonate in response to electromagnetic excitation with a $TE_{01\delta}$ mode as the fundamental mode, said $TE_{01\delta}$ mode having electric field lines oriented in a transverse direction around said dielectric resonator body, said body including a through hole in a longitudinal direction perpendicular to said $TE_{01\delta}$ mode, said body varying monotonically in cross-sectional area perpendicular to said longitudinal direction as a function of said longitudinal direction, wherein said body comprises a cone.

13. The dielectric resonator of claim 12 wherein said body comprises a truncated cone.

14. The dielectric resonator of claim 12 wherein said dielectric material has a dielectric constant of greater than about 45.

15. A dielectric resonator comprising a body formed of a dielectric material and adapted to resonate in response to electromagnetic excitation with a $TE_{01\delta}$ mode as the fundamental mode, said $TE_{01\delta}$ mode having electric field lines oriented in a transverse direction around said dielectric resonator body, said body including a longitudinal through hole, said body varying monotonically in cross-sectional area perpendicular to said longitudinal direction as a function of said longitudinal direction, wherein said body comprises at least two discontinuous truncated cones.

16. A dielectric resonator circuit comprising:

an enclosure;

an input coupler;

an output coupler; and at least one dielectric resonator having a body formed of a dielectric material and adapted to resonate in response to electromagnetic excitation with a $TE_{01\delta}$ mode as the fundamental mode, said $TE_{01\delta}$ mode having electric field lines oriented in a transverse direction around said dielectric resonator body, said body including a through hole in a longitudinal direction perpendicular to said $TE_{01\delta}$ mode, said body varying monotonically in cross-sectional area perpendicular to said longitudinal direction as a function of said longitudinal direction, wherein said body comprises a cone.

17. The dielectric resonator of claim 16 wherein said body comprises a truncated cone.

18. The dielectric resonator of claim 16 wherein said dielectric material has a dielectric constant of greater than about 45.

19. A dielectric resonator circuit comprising:

an enclosure;

an input coupler;

an output coupler; and at least one dielectric resonator having a body formed of a dielectric material and adapted to resonate in response to electromagnetic excitation with a $TE_{01\delta}$ mode as the fundamental mode, said $TE_{01\delta}$ mode having electric field lines oriented in a transverse direction around said dielectric resonator body, said body including a longitudinal through hole, said body varying monotonically in cross-sectional area perpendicular to said longitudinal direction as a function of said longitudinal direction, wherein said body comprises at least two discontinuous truncated cones.

* * * * *